US008439595B1

(12) United States Patent
Chaparro et al.

(10) Patent No.: US 8,439,595 B1
(45) Date of Patent: May 14, 2013

(54) PRE-EMPLACED ELECTRICAL VEHICLE RESTRAINT

(75) Inventors: Jordan E. Chaparro, King George, VA (US); Michael R. Duncan, Washington, NC (US); John R. Durbin, Fredericksburg, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/385,462

(22) Filed: Jan. 31, 2012

(51) Int. Cl.
*G08C 19/00* (2006.01)
*E01F 13/12* (2006.01)

(52) U.S. Cl.
USPC ..... 404/6; 404/9; 340/12.1

(58) Field of Classification Search ... 404/6, 9; 340/12.1
See application file for complete search history.

(56) References Cited

U.S. PATENT DOCUMENTS

| | | | | |
|---|---|---|---|---|
| 5,503,059 | A * | 4/1996 | Pacholok | 89/1.11 |
| 5,907,290 | A * | 5/1999 | Turner et al. | 340/12.1 |
| 6,527,475 | B1 * | 3/2003 | Lowrie | 404/6 |
| 6,752,381 | B2 | 6/2004 | Colak et al. | 254/88 |
| 7,011,470 | B1 * | 3/2006 | Breazeale et al. | 404/11 |
| 7,032,720 | B2 | 4/2006 | Jettéet al. | 188/36 |
| 7,264,092 | B2 | 9/2007 | Jetté | 188/36 |
| 7,475,624 | B1 * | 1/2009 | Daily | 89/1.11 |
| 8,025,306 | B2 | 9/2011 | Kurzka et al. | 280/402 |

* cited by examiner

*Primary Examiner* — Raymond W Addie
(74) *Attorney, Agent, or Firm* — Gerhard W. Thielman, Esq.

(57) ABSTRACT

A vehicle restraining system using an electrical impulse to disable the control system of a targeted vehicle including a roadway module placed at a location to engage the targeted vehicle for delivering the electrical impulse to the vehicle; a roadside module for generating the energy required for the electrical impulse and delivering the energy to the roadway module; and an operator interface module for operating the restraining system. In addition, a method of disabling the control system of a vehicle by delivering an electrical impulse to the vehicle includes the steps of charging a vehicle restraining system; setting the charged vehicle restraining system to disable the next encountered vehicle; detecting the next encountered vehicle, and delivering the electrical impulse to the targeted vehicle.

13 Claims, 4 Drawing Sheets

PRE-EMPLACED ELECTRICAL VEHICLE RESTRAINT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The present invention relates generally to vehicle restraining systems, and more particularly to an electrical restraining system that disable selected vehicles.

There is a strong need for technology of stopping a vehicle without injury to the vehicle occupant or significant damage to the vehicle. A vehicle restraining system may be deployed at a security check point. With civilian insurgence and terror warfare becoming an increasing problem in many regions, vehicle stopping technology is in demand by the military, as well as law enforcement agencies.

U.S. Patent Application Publication 2006/0045618 discloses a vehicle restraining system which may employ nets to restrain the vehicle. The restraining system includes a container having a hinged door fixed on the truss assembly. The system also includes two spaced-apart guides that extend from within the container to a portion of the truss assembly that contacts the ground. A gravitationally deployable restraining device, stored in and deployed from the container, includes sleeves, clips and keepers to deploy the restraining device to snare a vehicle. The nets are susceptible to damage caused by the vehicle running into them. The restraining devices may need to be replaced after each use. In addition, the system may cause injury to the occupants and damage to the vehicle.

Other alternative systems include barrier systems, tire spike strips, and electrical based stoppers such as high-powered microwave based systems and direct injection systems. These devices have various disadvantages, such as poor reusability, failing to selectively target vehicles and their emplacement may severely impact normal traffic flow. It is thus desirable to develop a reusable, easy to deploy, inexpensive vehicle restraining system.

The present invention aims at developing a restraining system for non-lethally stopping an unauthorized vehicle by disabling the vehicle's control electronics with high-power electrical impulses.

SUMMARY

Conventional vehicle checkpoint restraints yield disadvantages addressed by various exemplary embodiments of the present invention. In particular, various exemplary embodiments provide a vehicle restraining system using an electrical impulse to disable a targeted vehicle. The system comprises a roadway module placed at a location to engage the targeted vehicle for delivering the electrical impulse to the vehicle; a roadside module for generating the electrical impulse; and an operator interface module for operating the restraining system.

In another aspect, various exemplary embodiments provide a method for disabling a vehicle by delivering an electrical impulse to the vehicle, comprising steps of charging a vehicle restraining system; causing the charged vehicle restraining system to deliver the electrical impulse to the targeted vehicle.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

For illustrative purposes, the principles of the present invention are described by referencing various exemplary embodiments. Although certain embodiments of the invention are specifically described herein, one of ordinary skill in the art will readily recognize that the same principles are equally applicable to, and can be employed in other systems and methods. Before explaining the disclosed embodiments of the present invention in detail, it is to be understood that the invention is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

It must be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

In one aspect, the present invention is directed to a vehicle restraining system which employs an electrical impulse to disable a selected vehicle. The system comprises a roadway module placed at a location to engage the selected vehicle for delivering the electrical impulse to the selected vehicle; a roadside module for generating the electrical impulse; and an operator interface module for operating the restraining system.

The "electrical impulse" herein is defined as an electrical impulse with a voltage sufficiently high to at least temporarily disable the control electronics of a vehicle. A skilled person in the art may use simple experimentation to determine the necessary voltage for disabling a particular type of vehicle.

Figure 1:
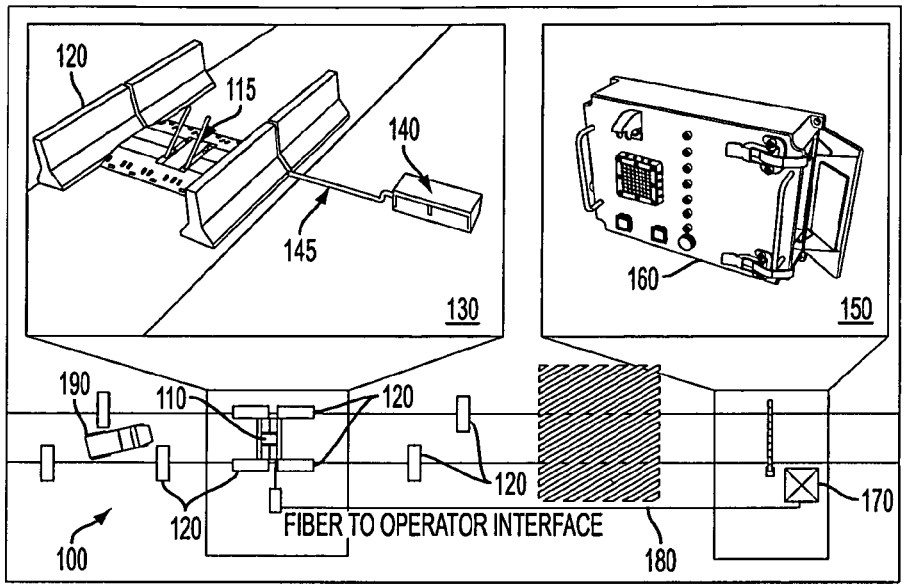
FIG. 1 is an elevation view of a first embodiment of a restraining system located at a vehicle control point.

Referring to FIG. 1, an exemplary embodiment of the restraining system according to the present invention is shown in an elevation view 100 implemented at a vehicle checkpoint. This system can be referred to as a pre-emplaced electric vehicle stopper (PEVS) system. A roadway tandem ramp 110 containing a roadway barrier module 115 therein may be located behind multiple modular concrete Jersey barriers 120, which are designed to slow down incoming traffic. A first detail perspective view 130 shows the tandem ramp 110 that connects to a roadside module 140 by a high-voltage interface cable 145. A second detail perspective view 150 shows an operator interface module 160 located, for example, at a checkpoint 170. A control cable 180 connects the roadside module 140 to the operator interface module 160. An exemplary embodiment may employ three barriers 120 arranged in a serpentine configuretion in FIG. 1 to slow down a vehicle 190. More barriers 120 may be used to induce the slowed traffic into a single lane, such that the vehicle 190 must pass directly over tandem ramp 110. More barriers 120 may be disposed in between the tandem ramp 110 and checkpoint 170 to slow down or retrain the vehicle 190 before checkpoint 170.

Personnel at checkpoint 170 may operate the restraining system using the operator interface module 160, preferably located sufficiently far away from tandem ramp 110 to enable a sentry to operate the restraining system from a safe standoff distance. In one embodiment, the operator interface module 160 and tandem ramp 110 may be 1000 feet or more apart. Exemplary embodiments therefore preferably use a lengthy control cable 180, which may be, for example, an optical fiber.

The three primary modules, the barrier module 115, the roadside module 140, and the operator interface module 160, may be environmentally sealed to protect the subassemblies and components within. This provides the advantage that water and/or dust will be prevented from fouling the system and causing damage to sensitive parts therein. The three primary modules, and some of the subsystems within them, may also be shielded from electromagnetic interference (EMI). This is to prevent potential interference with the normal function of the device by the EMI from the various components, or outside interference such as radio signals, lightning or EMI-emitting devices.

Figure 2:
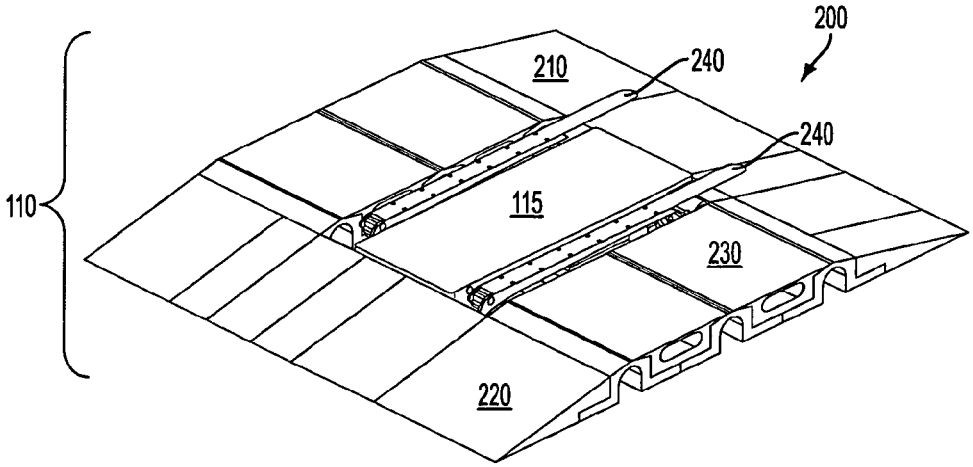
FIG. 2 is a perspective view of an example of a roadway barrier module in the rest position within a module speed bump ramp.

A. The Roadway Barrier Module: Referring to FIG. 1, the Jersey barriers 120 limit traffic to a single lane, thereby directing the vehicle 190 to pass over the tandem ramp 110 disposed between two parallel barriers 120. Referring to FIG. 2 with perspective view 200, the tandem ramp 110 may include a modular speed bump comprising an approach ramp 210, an exit ramp 220, and a bridge 230 there-between to support and protect the barrier module 115. The weight of the vehicle 190 is transferred to the bridge 230 of the tandem ramp 110, to prevent damage to the tandem ramp 110 from passing traffic. The tandem ramp 110 also serves to slow the vehicle 190 so as to facilitate engagement of electrodes 240 of the tandem ramp 110 with the vehicle 190 for delivery of the electrical impulse. The tandem ramp 110 may be any suitable commercial-off-the-shelf (COTS) speed bump structure, or can be customized for a particular shape or size according to various embodiments.

The tandem ramp 110 also includes two electrodes 240, shown in FIG. 2 in the retracted or rest position, are located at the top of the tandem ramp 110. Electrodes 240 can rise to an elevation position to physically contact the vehicle 190 for delivering an electrical impulse to the vehicle 190 when disposed over the tandem ramp 110. The control electronics of vehicle 190 can be disabled by application of a sufficiently powerful electrical impulse. Various exemplary embodiments can disable the vehicle 190 for at least a short period time, preferably, at least 2-to-5 minutes in this manner. After delivery of the electrical impulse, the electrodes 240 may be retracted to their rest position.

Figure 3:
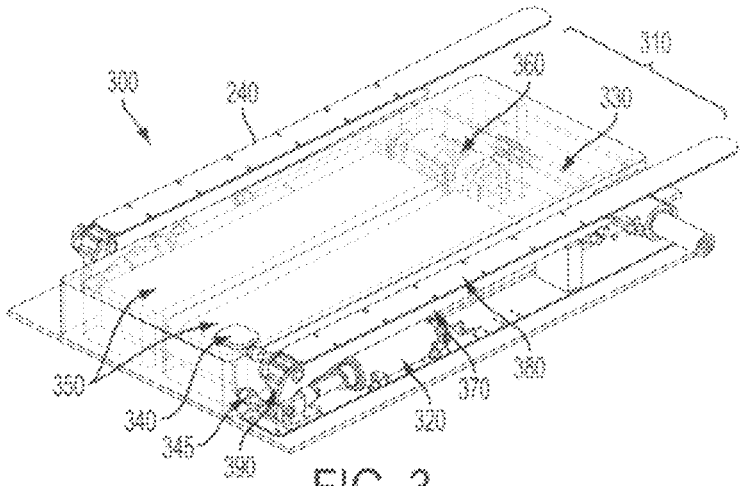
FIG. 3 is a perspective view of a partial cutaway view of the barrier module.

The internal components of one embodiment of the barrier module 115 are shown in FIG. 3 in a perspective view 300. The tandem ramp 110 may contain a pulse charged high-voltage resonator or oscillator 310 which modulates the system waveform, pneumatic connections 320 for actuating electrodes 240, an interface for the high-voltage transmission line feed-through connection 330, and vehicle detection triggering hardware such as a pressure-plate sensor 340 used to determine when the vehicle 190 is suitably positioned for delivery of the electrical impulse by the barrier module 115.

The barrier module 115 is designed to deliver a high-voltage electrical impulse generated by a high-voltage oscillator 310, which comprises the transmission line feed-through connection 330, at least one capacitor 350 and a peaking switch 360. Any commercial capacitor capable of storing a sufficient quantity of charge to deliver the desired electrical impulse may be used. In an exemplary embodiment, two capacitors 350 shown in FIG. 3 correspond to 1500 kV General Atomic peaking capacitors. The switch 360 can switch on the capacitor 350, which then delivers the electrical energy to electrodes 240. The switch 360 may be a dry-air peaking switch, which may be custom designed for specific conditions, if desired.

The electrodes 240 have arms designed to contact with the targeted vehicle 190 for delivering an electrical impulse thereto upon raising the electrodes 240. Referring to FIG. 3, each electrode 240 includes a rigid frame arm 370 and a flexible spring steel face plate 380 for contacting the targeted vehicle 190. Preferably, electrodes 240 are designed to maximize the contact surface between the electrodes 240 and the vehicle 190 to facilitate delivery of the electrical impulse with minimal electrical resistance. In exemplary embodiments, the electrodes 240 may be actuated by a pressurized two-port air cylinder 320 that also provides resistance to the impact between the electrodes 240 and the vehicle 190 when the electrodes 240 are raised into its impulse delivery position. The two-port air cylinder 320 also facilitates remote actuation of electrodes 240 via pressurization of either side of the cylinder 320. A linear dampener 390 is optionally attached to the electrode 240 to prevent rebound from the impact of the electrodes 240 with the vehicle 190.

Figure 4:
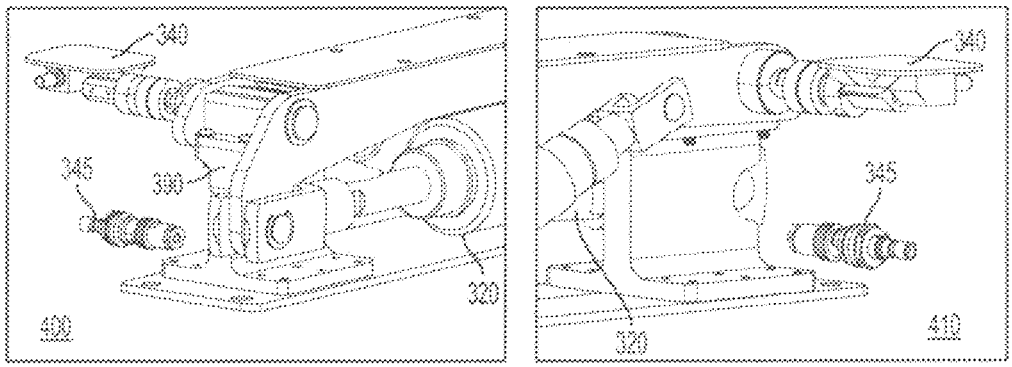
FIG. 4 is a perspective view of an example of vehicle detection triggering hardware in a barrier module.

In another embodiment, electrodes 240 may be attached to a bus plate through a pillow bearing (such as the dampener 390) that connects electrodes 240 to the arms 370 for the oscillator 310 of the barrier module 115. Optionally, a cam attached to the grounded electrode 240 by a shaft depresses the spring-mounted piezoelectric sensor 340 that can alternatively constitute a strip. In response, the sensor 340 produces voltages proportional to the speed of deflection of the electrodes 240 that trigger the system. The sensor 340 connects to an exterior connector 345 for connecting cable 145 with the roadside module 140. In exemplary embodiments, the exterior connector 345 constitutes a Bayonet Neill-Concelman (BNC) connector, and the cable 145 is an RG-223 cable. FIG. 4 shows additional details in the perspective views 400 and 410 of the relationship among the electrodes 240, the sensor 340 and the exterior connector 345.

Figure 5:
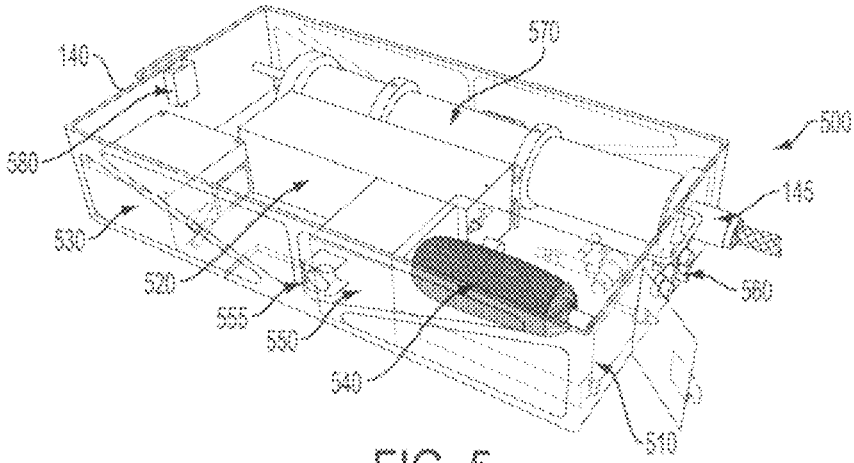
FIG. 5 is a perspective view of a partial cutaway view of the roadside module.

B. The Roadside Module: The primary function of the roadside module 140 is to generate the energy required for the electrical impulse and transmit it to the barrier module 115 upon receipt of a command from the operator interface module 160. Referring to a perspective view 500 in FIG. 5, the depicted roadside module 140 comprises a battery module 510, a primary high-voltage power supply (HVPS) 520, control electronics 530, a pneumatic carbon fiber bottle 540, an Optical Relay Subassembly (ORS) 550 with a stop switch 555, fiber optic connectors 560, the high-voltage transmission line 145, a Marx generator 570 for producing sparks, and a power-cutoff (i.e., kill) switch 580.

The outer enclosure of roadside module 140 is environmentally sealed and shielded against electromagnetic interference (EMI). The outer enclosure can be access-restricted with exterior interfaces for only the high-voltage output cable 145, the control fiber optic cable 180, and an access panel for changing the battery module 510 and the pneumatic bottle 540. Several of the subsystems of the roadside module 140 are preferably housed in separate thin-walled EMI shielded enclosures to protect them against local interference from high-power electronics.

The primary electrical power source or battery module 510 of roadside module 140 may be any charge storage device capable of withstanding the high average (~4 kW) and peak (>25 kW) powers drawn by the restraining system while in operation. The battery module 510 is preferably as compact as possible while still maintaining the necessary functionality. In some embodiments, traditional lithium-ion batteries are preferred for their high energy-density. Unfortunately, lithium-ion batteries are prone to gaseous electrolyte venting, which leads to thermal runaway when high currents are drawn or when the cells are over- or under-charged.

Lithium-iron-phosphate ($LiFePO_4$) cells are preferable for various embodiments because they are more stable for operation with high peak power and are better able to withstand cell voltage abuse while maintaining a high energy density, as compared with other stable rechargeable cells.

Figure 6:
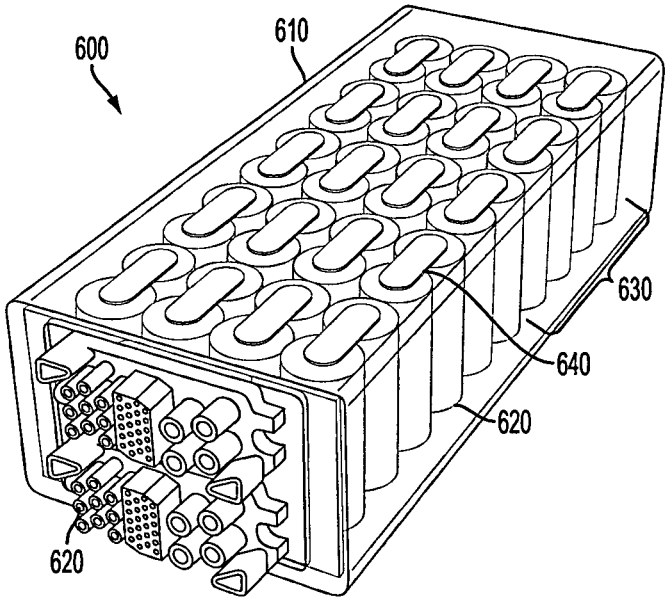
FIG. 6 is a perspective view of a battery module as the prime power source implemented with 40 A123 $LiFePO_4$ cells.

In one exemplary embodiment shown in FIG. 6 in a perspective view 600, the battery module 510 serving as a power source can be a 133 V (volt) $LiFePO_4$ battery pack 610 consisting of forty 3.3 V, 10 Ah (amp-hour) cells 620. Such a battery pack 610 generates peak currents in excess of 200 A to drive the restraining system and can maintain stable operation for hundreds of 1-second bursts on a single charge. The dimensions of the battery pack 610 in this exemplary embodiment are 12"×4.5"×2.5". Internally, the battery pack 610 in this exemplary embodiment is separated into four packs 630 of ten cells 620, each cell equipped with direct connections 640 to individual cells for balanced charging and thermocouples to monitor the battery temperature. These four packs of batteries are connected in series, and electrical power transmits via a connector interface 650.

The batteries of the primary power source's battery module 510 are optionally connected through the connector interface 650 that connects to a sub-assembly denoted the ORS 550, which manages the supply rails 380 for the rest of the subsystems in the tandem ramp 110. The ORS 550 is housed in an EMI shielded sub-enclosure and has external interfaces for battery connection, fiber optic lines, and coaxial conductors that are used for connecting the supply rails 380 to the rest of the system components.

The ORS 550 facilitates normal operation of the prime power source 510. In one exemplary embodiment, the 133 V potential from the $LiFePO_4$ battery pack 610 is passed through a DC-to-DC converter to provide a $24V_{DC}$ supply to the system controller 560 and the HVPS 520. The unregulated 133 V battery voltage from the battery module 510 may also be passed to the HVPS 520 through the high-power relay, which is controlled by a fiber optic latch, the combination constituting the ORS 550. Such a design of the ORS 550 may provide a key safety feature for the restraining system which enables the sentry at the operator interface module 160 to cut off the supply voltage to the electronics 530 remotely by turning off the restraining system through a kill switch 580. Loss of the 24 V converter also results in the opening of this high-power ORS 550 that can provide a key failsafe of the restraining system. In addition to these functions, the ORS 550 may also monitor the voltage and temperature of the HVPS 520, relaying this information to the system controller 560 through a fiber optic serial interface controlled by a field programmable gate array (FPGA).

The HVPS (power supply) 520 receives energy from the primary power source constituting the battery module 510. In exemplary embodiments, the HVPS 520 is resonant, suitable for constant current and high-voltage. The HVPS 520 is preferably capable of enduring the harsh operating environment associated with operation of this restraining system, such as the environment which may be encountered in connection with energy weapons. In addition, the HVPS 520 is preferably suitable for use with a lower voltage prime power source or battery module 510 and the much higher associated currents.

Figure 7:
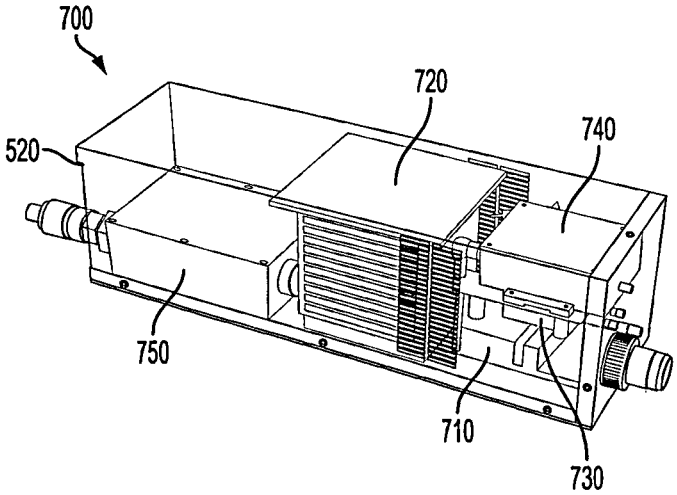
FIG. 7 is a perspective view of a partial cutaway view of a high-voltage power supply.

Referring to the perspective view 700 of the power supply in FIG. 7, in an exemplary embodiment, the HVPS 520 utilizes a 300 A insulated gate bipolar transistor (IGBT) half bridge module 710 to drive a modified COTS high-voltage transformer tank 720. The drive signals, which are generated by the system controller 560, are relayed to the HVPS 520 through isolated fiber optic connections. Output voltage is monitored by a secondary side voltage divider 730, which relays the signal to the system controller 560 through a CPLD feedback circuit 740. An oil insulated protection circuit 750 adjacent the tank 720 protects the output rectifier from reflected transients and reverse voltages. Additionally, a bleed-off resistor in the protection circuit 750 prevents the generator 570 from maintaining a charge in the event of a misfire. This can also be a key safety feature for the high-voltage side of the roadside module 140.

The system controller 560 is a computer based control system. The system controller 560 has multiple functions: interfacing with the operator interface module 160, controlling the HVPS 520, monitoring voltage and temperature readouts of the prime power source as the battery module 510, monitoring pneumatic pressures, and controlling the pneumatic actuators. Additionally, the system controller 560 may optionally be capable of recording diagnostic logs and providing readouts on various system components. The system controller 560 is housed in an EMI shielded enclosure to prevent interference from other components of roadside module 140. In some embodiments, the EMI shielded enclosure may by optionally be made from aluminum and is provided with multiple fiber optic connectors, one Bayonet Neill-Concelman (BNC) input for power, and two ports for connection of pressurized air lines.

In one exemplary embodiment, the system controller 560 is built around a Freescale ColdFire Microcontroller and a Spartan® II FPGA. Such a system controller 560 has ten fiber optic transmitters and six receivers which interface through the FPGA to the microcontroller. The system controller 560 of this exemplary embodiment further comprises two pressure transducers in order to monitor the pneumatic systems. The system controller 560 utilizes a super-capacitor backup supply to enable turning off primary power source 510 and switch into a suspended low power state.

The Marx generator 570 in the roadside module 140 is charged by the HVPS 520. The generator 570 can, when fired, produce high-voltage electrical impulse for charging the barrier module's oscillator 310. Any generator suitable for producing a high-voltage electrical impulse may be used for without departing from the invention's scope. In one exemplary embodiment, a commercially available Marx generator from Applied Physical Electronics LC can be used, using fifteen capacitive stages charged to 40 kV to produce an open circuit output voltage of 600 kV. The Marx generator impedance is around 60Ω (ohms) and fires into a 230 $kV_{DC}$-50Ω-coaxial cable load with customized feed-through interfaces on the generator 570 and the oscillator's electrodes 240.

A pneumatic system, preferably a dry air pneumatic system, can be used in the restraining system to set breakdown voltages in the generator 570 and roadside module 140 peaking gap as well as to actuate electrodes 240 from the rest position to the raised position. The system controller 560 exercises some of control over various components through this pneumatic system. Optionally, ventilation valves are used to prevent over-pressurization of the pneumatic system components due to thermal expansion. Compact regulators are used to set the pressure of the generator and peaking gaps. A four-port solenoid driven valve is used to pressurize and exhaust the two sides of the electrode actuation cylinders 320. In one exemplary embodiment, a COTS 17 $ft^3$, 4500 psig carbon fiber bottle, typically used for paint-ball systems, is used as a dry air source for the pneumatic system. A three-stage 4500 psig dry air compressor is used to charge the cylinders 320.

C. The Operator Interface Module: The operator interface module 160 is connected to roadside module 140 using fiber optic control cable 180, preferably of sufficient length, for example length of 1000 feet or more, to provide a suitable stand-off distance between the operator interface module 160 and the tandem ramp 110. One exemplary operator interface module 160 is shown in perspective view 700 in FIG. 7. Inside of the operator interface module 160, there is a simple control board that manages the various interface indicators and user inputs. The simple control board also manages the serial communication with the system controller 560 of roadside module 140. Operator interface module 160 is preferably powered by its own battery, such as a COTS rechargeable lithium-ion battery.

Figure 8:
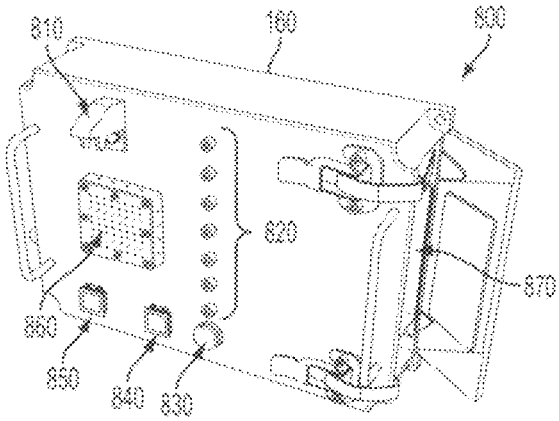
FIG. 8 is a perspective view of a operator interface module.

Referring to the perspective view 800 in FIG. 8 of an exemplary embodiment, the operator interface module 160 has an on/off toggle switch 810, which also functions as a remote emergency stop for the high-voltage components of the tandem ramp 110. The status indicator LED array 820 provides feedback to the operator on system pressure and voltage levels. For example, three LEDs in the status indicator array 820 serve as a generalized error code that can provide more detailed information on system faults. A status check button 830 sends requests for information and receives the information from the system sensors, such as the vehicle sensor 340. The received information may be displayed on the status LED array 820. The arm button 840 on the operator interface module 160 enables the sentry to charge the capacitor 350 and arm the system. The enable button 850 enables the sentry to command the restraining system to engage the next encountered vehicle. An arm buzzer 860 may be included to provide sentries with a non-visual confirmation that the restraining system is armed. A hatch panel 870 provides physical access to the operator interface module 160.

D. The High-Voltage Interface: The high-voltage interface cable 145 may be a special cable transmission line connecting the high-voltage generator 570 to the barrier module's oscillator 310. The cable 145 must be suitable for transmitting high-voltage power from the generator 570. In one exemplary embodiment, an Okonite, 230 $kV_{DC}$-rated x-ray cable is used.

Figure 9:
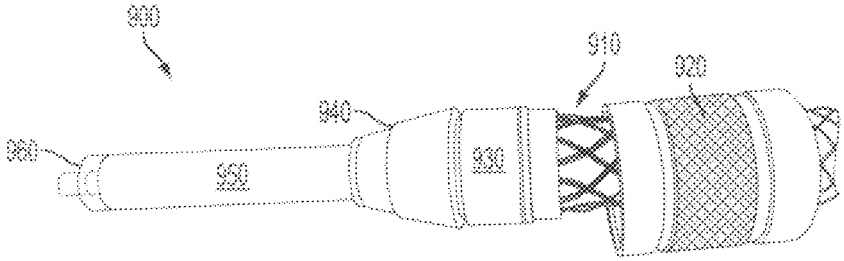
FIG. 9 is an elevation view of a cable terminus.

The connections at both ends of cable 145 are preferably sealed and mated to the generator 570 and barrier module's oscillator 310. A skilled artisan may modify the connecting terminals of the cable 145 according to specific structural features of either the generator 570 or the oscillator 310. On the side of the generator 570, the cable 145 mates with the output of the spark-gap and seal the pressurized enclosure used to insulate the generator 570, as shown in the perspective view 900 of FIG. 9 illustrating the cable 145 wrapped by an outer braid 910 and ending with a threaded connector 920, a ground (GND) connection with strain relief 930, an enclosure seal 940 and a potted seal 950 at a connector interface 960. To accomplish this, the terminal of the cable 145 may be sealed around an inner conductor using a silicone potting material, shown by the potted seal 950 that matches the dielectrical properties of the cable's insulation. The outer braid of the cable 145 is sealed using a rubber boot typically used to seal COTS cable assemblies.

Figure 10:
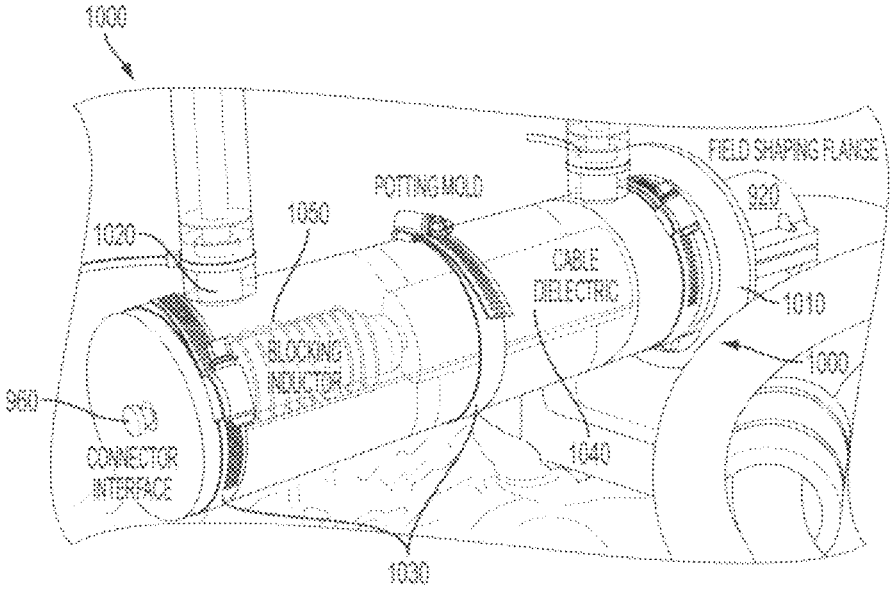
FIG. 10 is a perspective view of a mold for the cable.

The side of the cable 145 at the barrier module 115 requires, in an exemplary embodiment, the entire assembly to be encapsulated in silicone potting to prevent arcing and flashover along the length of the cable 145. As shown in the perspective view 1000 of FIG. 10 regarding the vacuum potting process to facilitate the cable 145 being encapsulated. A field-shaping flange 1010 supports a mold 1020 made from semi-cylindrical portions held together by adjustable straps 1030 to position a cable dielectric 1040 and a blocking inductor 1050. the field-shaping flange 1010 is used to manage the transition point at the termination point of an outer conductor of the cable 145. The blocking inductor 1050 is integrated into the potted assembly to prevent output from the barrier module's oscillator 310 from ringing back down the transmission line conduit formed by the cable 145.

At the terminus 960 of the cable 145, a fitting can be attached to plug into the internal terminal of the tandem ramp 110. The exemplary embodiment may use a customized cable 145, which is produced from the custom mold, which contains the terminus of the cable 145 between the connector 920 and the connector interface 960. Once removed from the mold 1020, the potted assembly may be shrink-wrapped and a custom dust cap can be used to prevent damage to the assembly when not in operation.

The vehicle restraining system of the present invention may be deployed at vehicle security check points at locations such as Forward Operations Bases (FOBs), Continental United States (CONUS) and Outside the Continental United States (OCONUS) military bases, and/or Department of Justice facility locations, as well as any other location desiring to control vehicular access.

The restraining system of the present invention has several advantages over the currently fielded vehicle stopping systems, such as restraining nets. These advantages include, lower cost per engagement (a cost reduction by a factor of 50-to-100 times may be achievable), a high degree of reusability, the ability to selectively target vehicles, that the emplacement does not interrupt normal traffic flow, the ability to quickly remove affected vehicles, and the effectiveness of the system is not tied to the momentum of the target.

The disclosure is illustrative only, and changes may be made by those sufficed in the art in detail, especially in matters of shape, size and arrangement of parts within the principles of the invention to the full extent indicated by the broad general meanings of the terms in which the appended claims are expressed. Accordingly, departures may be made from such details without departing from the spirit or scope of present PEVS invention.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A vehicle restraining system using an electrical impulse to at least temporarily disable a vehicle, comprising:

a roadway module placed at a location for engagement with a vehicle for delivery of the electrical impulse to the vehicle;

a roadside module generating and storing energy and operatively connected to the roadway module for delivering energy to the roadway module to provide the electrical impulse; and an operator interface module operative connected to at least the roadside module for operating the vehicle restraining system, wherein said roadside module comprises a system controller operatively connected to the operator interface module for controlling and monitoring the restraining system and providing feedback to the operator interface module, and said roadside module comprises a generator and a pneumatic system that sets breakdown voltages in the generator.

2. The vehicle restraining system of claim 1, wherein said electrical impulse has a voltage sufficient to disable control electronics of a vehicle for at least two minutes.

3. The vehicle restraining system of claim 1, wherein at least some components of the roadside module are shielded against electromagnetic interference.

4. The vehicle restraining system of claim 1, wherein said roadway module comprises two electrodes movable from a rest position to an actuated position where the electrodes contact the vehicle.

5. The vehicle restraining system of claim 4, wherein each of the electrodes has a flexible spring surface for maximizing contact between said electrodes and the vehicle.

6. The vehicle restraining system of claim 5, wherein said roadway module includes a pneumatic system to actuate said electrodes.

7. The vehicle restraining system of claim 1, wherein said roadway module includes a sensor for producing a trigger signal to trigger actuation of the vehicle restraining system.

8. The vehicle restraining system of claim 1, further comprising at least one speed bump for operatively associated with said roadway module to slow a vehicle passing over the roadway module.

9. The vehicle restraining system of claim 1, wherein said roadside module comprises an optical relay assembly to manage a power supply rail.

10. The vehicle restraining system of claim 1, wherein said roadside module comprises a protection circuit.

11. The vehicle restraining system of claim 1, wherein said operator interface module comprises a device to allow a user to use the operator interface module to arm the restraining system.

12. The vehicle restraining system of claim 11, wherein said operator interface module comprises a device to deactivate the restraining system after the restraining system has been armed.

13. The vehicle restraining system of claim 1, wherein said operator interface module is connected to said roadside module by a fiber cable of at least 1000 feet in length to provide a sufficient standoff distance between said operator interface module and said roadside module.

* * * * *